US005365893A

United States Patent [19]

Wissmann et al.

[11] Patent Number: 5,365,893

[45] Date of Patent: Nov. 22, 1994

[54] FUEL-INJECTION ARRANGEMENT FOR AN INTERNAL COMBUSTION ENGINE

[75] Inventors: Michael Wissmann, Mettmann; Hans Nickel, Cottenweiler; Roland Schierling, Affalterbach; Roland Adam, Besigheim; Werner Geyer, Waiblingen, all of Germany

[73] Assignee: Andreas Stihl, Waiblingen, Germany

[21] Appl. No.: 93,160

[22] Filed: Jul. 19, 1993

[30] Foreign Application Priority Data

Jul. 18, 1992 [DE] Germany ..... 4223758

[51] Int. Cl.[5] ..... F02B 33/04

[52] U.S. Cl. ..... 123/73 C; 123/179.17; 123/DIG. 5

[58] Field of Search ..... 123/73 C, DIG. 5, 179.17, 123/73 AD; 417/380, 395

[56] References Cited

U.S. PATENT DOCUMENTS 4,846,119 7/1989 Geyer et al. ..... 123/73 C

FOREIGN PATENT DOCUMENTS 2141648 2/1972 Germany ..... 123/179.17

*Primary Examiner*—Noah P. Kamen

*Attorney, Agent, or Firm*—Walter Ottesen

[57] ABSTRACT

The invention is directed to a fuel-injection arrangement for a two-stroke engine in a portable handheld work apparatus such as a motor-driven chain saw or the like. Fuel is drawn by suction from a fuel tank by a fuel-feed pump and is made available at the suction connection of an injection pump. The injection pump has a pressure connection which is connected to an injection line through which the engine is supplied with fuel. A rapid start of a two-stroke engine provided with this fuel-injection arrangement is achieved by providing a bypass line which conducts fuel and bypasses the injection pump. A switchable flow valve is mounted in the bypass line. The bypass line opens directly into the intake channel conducting combustion air to the engine so that even without the pump action of the injection pump, adequate fuel is made available to the engine for starting the same.

12 Claims, 5 Drawing Sheets

Fig. 5
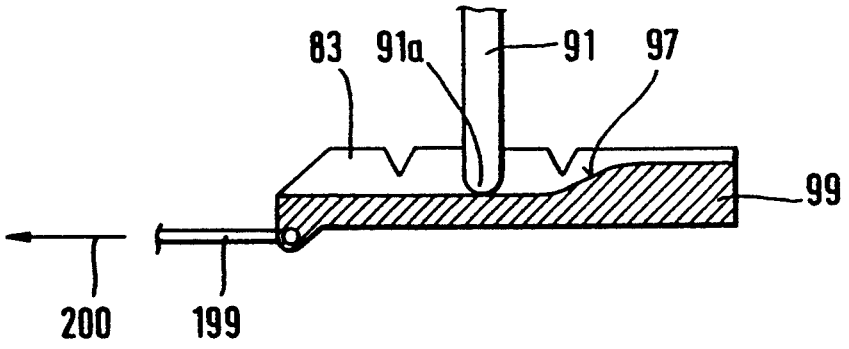
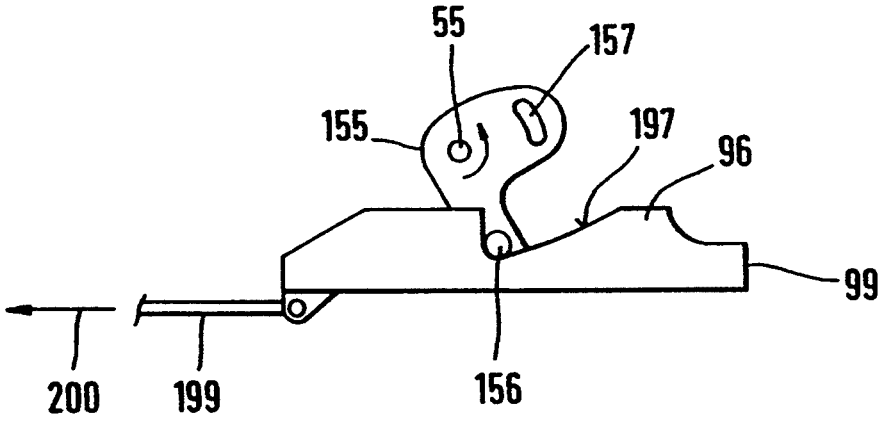
Fig. 6

FUEL-INJECTION ARRANGEMENT FOR AN INTERNAL COMBUSTION ENGINE

FIELD OF THE INVENTION

The invention relates to a fuel-injection arrangement for an internal combustion engine and especially a two-stroke engine in a portable handheld work apparatus such as a motor-driven chain saw or the like.

BACKGROUND OF THE INVENTION

A fuel-injection arrangement of this kind is disclosed in U.S. Pat. No. 4,846,119. Fuel under pressure is made available to the suction connection of an injection pump by a fuel-feed pump so that the fuel is drawn in by suction free of bubbles during the suction stroke of the injection pump and is pumped in the following injection cycle via the pressure connection and an injection line to the internal combustion engine and is preferably injected into the combustion chamber of the two-stroke engine. For starting the engine, it must be ensured that the pump chamber of the injection pump is filled with fuel so that adequate fuel flows via the injection line to the engine when the pump piston plunges. If the valves mounted in the fuel-injection arrangement leak slightly, then the injection pump as well as the fuel-feed pump can run empty after being at standstill for a longer period of time. The start of the two-stroke engine provided with a fuel-injection arrangement of this kind is then very difficult because no fuel is injected into the combustion chamber notwithstanding the injection pump being actuated. Two-stroke engines of this kind are, as a rule, started with a manually-actuated starting device. The fuel-feed pump will pump fuel only after several start attempts so that the injection pump can take up its work after several strokes without fuel. If pressure-holding valves, suction valves or the like close only incompletely, then the pump action can go toward zero, therefore making a start of the engine impossible.

SUMMARY OF THE INVENTION

It is an object of the invention to provide a fuel-injection arrangement of the kind described above which makes it possible to start the internal combustion engine with little effort even when the injection pump is not yet pumping fuel.

The fuel-injection arrangement of the invention is for an internal combustion engine such as a two-stroke engine of a portable handheld work apparatus such as a motor-driven chain saw and the like. The engine has an intake channel for conducting combustion air into the engine and the fuel-injection arrangement includes: a fuel tank for supplying fuel for the engine; a fuel-feed pump having a suction line connected to the fuel tank and a pressure line; a fuel-injection pump having a suction end connected to the pressure line and a pressure end for supplying fuel; an injection line connected to the pressure end for conducting the fuel to the engine; a bypass line bypassing the fuel-injection pump for conducting fuel into the intake channel of the engine; and, a switchable flow valve connected into the bypass line.

The bypass line bypasses the injection pump and opens into the intake channel. By means of this fuel-conducting bypass line, fuel is drawn directly into the combustion air because of the underpressure present in the intake channel so that an ignitable mixture results which makes starting the engine possible even when the injection pump is not pumping. As soon as the injection pump takes up its pumping activity, the bypass line is closed by the switchable flow valve and the engine operates in a known manner via the fuel-injection arrangement. The switchable bypass line makes a start of the engine possible after only a few revolutions of the crankshaft without it being necessary for the injection pump to pump fuel. This is especially the case for manually-started two-stroke engines.

The bypass line provided as a feature of the invention also makes an emergency operation of the engine possible when the injection pump or the fuel-feed pump malfunctions. The switchable flow valve is opened especially manually for operating the engine when an operating unit of the fuel-injection arrangement malfunctions. In this way, fuel can flow via the bypass line to the intake channel and enter the channel in the same manner as in a conventional carburetor, preferably rearward of the throttle flap, viewed in flow direction and, together with the inflowing combustion air, form an ignitable mixture.

The fuel-feed pump, the injection pump, the bypass line and the flow valve as well as a section of the intake channel are advantageously arranged in a common injection-pump block so that the bypass line is itself configured so as to be integrated into the injection-pump block, thereby making external lines unnecessary.

The bypass line opens into the intake channel rearward of the throttle flap when viewed in the flow direction of the combustion air and enters preferably via a nozzle bore so that the throttle flap simultaneously takes over the function of a choke flap in the start case.

According to another feature of the invention, the bypass line branches off from the pressure line of the fuel-feed pump so that the engine draws fuel by suction from the fuel tank via the bypass line and the fuel-feed pump. In this way, it is ensured that fuel from the fuel tank is drawn by suction via the fuel-feed pump even for fuel-feed pumps which are not self-priming. As soon as the fuel enters into the fuel-feed pump, the fuel-feed pump takes up its pumping activity and supports the fuel flow to the internal combustion engine. A control chamber is arranged forward of the flow valve in order to supply the fuel to the internal combustion engine at the same pressure level. The control chamber is preferably integrated into the injection-pump block and the control membrane of the control chamber controls a fuel-feed valve via an actuating pin.

In a preferred embodiment, the valve member of the flow valve is completely arranged in the bypass line with an end of the valve member being in contact engagement with a sealing membrane which delimits the bypass line in the region of the flow valve. An actuating pin for switching the valve is provided on the dry side of the sealing membrane so that the fuel side is separated from the actuating side of the flow valve without a complicated seal arrangement.

BRIEF DESCRIPTION OF THE DRAWINGS

The invention will now be described with reference to the drawings wherein:

FIG. 5 is a schematic representation of the slider, in section, having a first wall defining a ramp for actuating the bypass valve with the aid of an actuating pin; and, FIG. 6 is another schematic representation of the slider of FIG. 5 wherein a second side wall thereof for acting on the throttle flap is shown with the second side wall obscuring the first side wall.

DESCRIPTION OF THE PREFERRED EMBODIMENTS OF THE INVENTION

Figure 1:
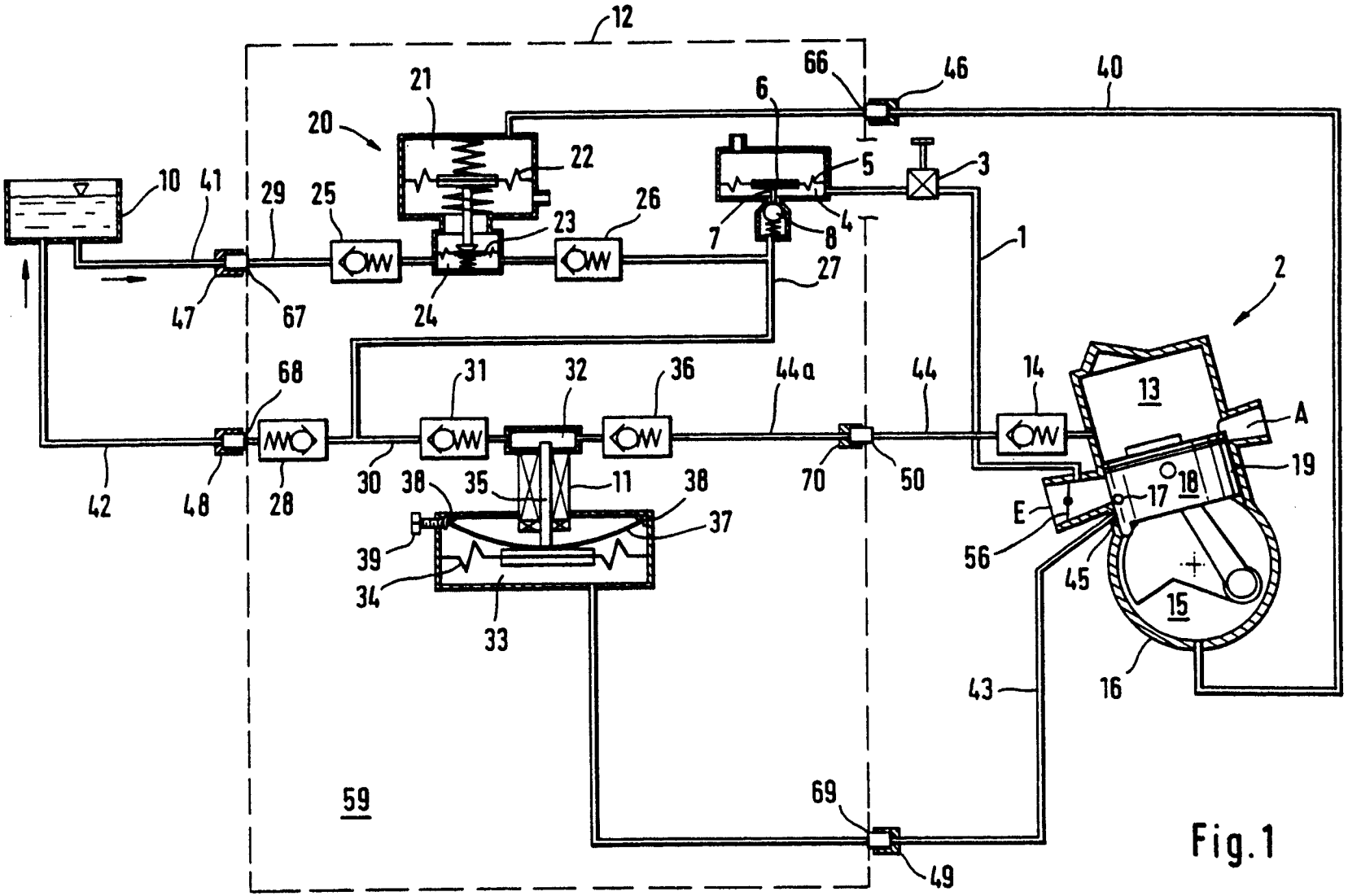
FIG. 1 is a schematic showing the operation of a fuel-injection arrangement for an internal combustion engine.

The fuel-injection arrangement shown in FIG. 1 is for an internal combustion engine and especially for a two-stroke engine in a portable handheld work apparatus such as a motor-driven chain saw, cutoff machine, brushcutter or the like. In the embodiment shown, the fuel-injection arrangement is provided as an assembly unit in the form of an injection-pump block 12 (FIG. 2) in which a fuel-feed pump 20 and an injection pump are integrated as essential functional groups of the fuel-injection arrangement. The fuel-feed pump 20 is fixed as an attachment component to the base body 59 of the injection-pump block 12.

The fuel-feed pump 20 is driven by the crankcase pressure of the two-stroke engine 2. For this reason, a work chamber 21 delimited by a membrane 22 is connected via a line 40 to the inner space 15 of the crankcase 16. The membrane 22 controls a pump membrane 23 via a pin and the pump membrane 23, in turn, delimits a pump chamber 24. The pump chamber 24 communicates via a suction valve 25 with a fuel feed 41. The fuel feed 41 supplies fuel from the fuel tank 10. The fuel is supplied to a suction connection 30 of the injection pump 11 via a pressure valve 26 and a pressure line 27. The injection pump 11 is connected via a suction valve 31 to an injection-pump chamber 32. When the suction valve 31 is closed, the fuel pumped by the fuel-feed pump 20 flows back into the fuel tank 10 via a pressure-holding valve 28 and a fuel return 42. When the suction valve 31 is closed, the fuel-feed pump 20 recirculates the fuel from the fuel tank 10.

The injection pump 11 includes a work chamber 33 which is delimited by a membrane 34 which actuates a pump piston 35. The work chamber 33 communicates via a pulse line 43 and a bore 45 with the inner space 15 of the crankcase 16. The bore 45 is then controlled by a control opening 17 in the piston skirt 18 of the piston 19 so that the pump piston 35 injects fuel into the combustion chamber 13 (in correspondence to the position of the piston 19) via the pressure valve 36 and the injection line 44 as well as the injection valve 14. A force is applied to the pump piston 35 by a leaf spring 37 which determines the rest position of the pump piston 35. The ends of the leaf spring 37 lie in bearings 38 which are supported in the housing of the injection pump 11. One of the bearings 38 is adjustable in its position via an adjusting screw 39 whereby the pretension of the leaf spring 37 can be adjusted.

The engine 2 draws in the combustion air necessary for combustion via an intake channel E into the inner chamber 15 of the crankcase housing 16. The combustion air enters the combustion chamber 13 via flow channels (not shown) controlled by the piston. The exhaust gas developed by the combustion is conducted from the combustion chamber 13 via the exhaust channel A.

Figure 2:
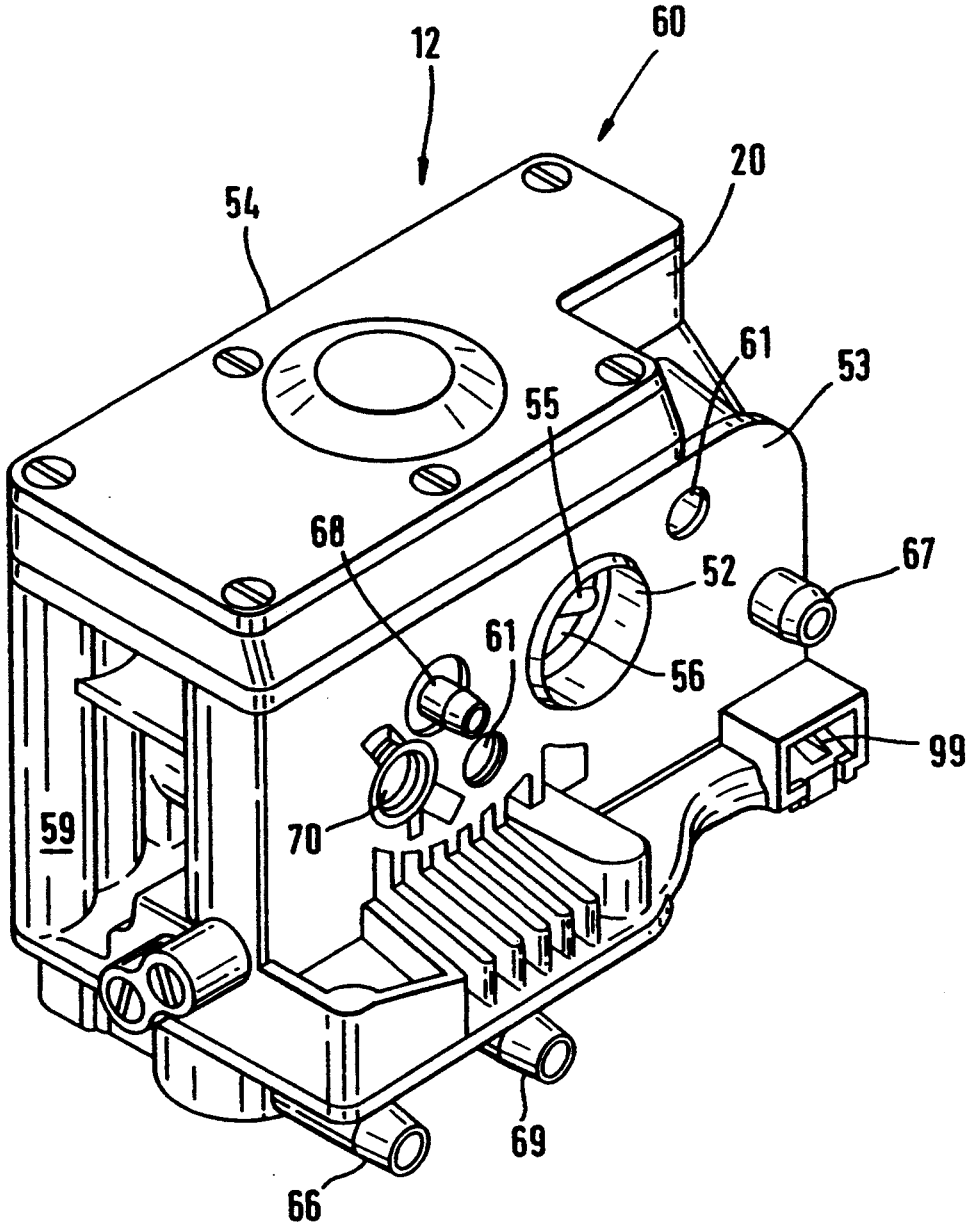
FIG. 2 is a perspective view of an injection-pump block.

A throttle flap 56 is mounted in the intake channel E for controlling the quantity of combustion air drawn in by suction. In the embodiment of FIG. 2, a section 52 of the intake channel E is formed in the injection-pump block 12. The intake channel E passes through the block along a straight line from one end face 53 of the injection-pump block 12 to the other end face 54 thereof. The throttle flap 56 is journalled in the intake channel section 52 so as to pivot on a pin 55. The quantity of the inflowing combustion air is adjustable via the throttle flap 56. The throttle flap 56 is actuated from a throttle lever via a linkage (not shown).

The required lines between the injection pump block 12, the internal combustion engine 2 and the fuel tank 10 are connected via plug-in elements 66 to 69 and connecting receptacle 70 to which the line ends 46 to 50 connect. The injection-pump block 12 can be fixed to the engine 2 or on a housing accommodating the engine 2 by means of stud bolts. The stud bolts extend parallelly to the intake channel section 52 and project through bores 61 provided in the injection-pump block 12.

As shown in FIG. 1, the fuel-injection arrangement includes a bypass line 1 which opens directly into the intake channel E of the engine 2 while bypassing the injection pump; the bypass line 1 opens preferably downstream of the throttle flap 56 viewed in the flow direction of the combustion air. A switchable flow valve 3 is mounted in the bypass line 1. With the flow valve 3, the bypass line 1 conducting the fuel can be blocked or opened. It can be advantageous to provide intermediate positions in a similar manner to also adjust the quantity of fuel supplied via the bypass line 1 to the intake channel E.

In the embodiment shown, the bypass line 1 branches off from the pressure line 27 of the fuel-feed pump 20. It can be advantageous to branch off the bypass line 1 directly from the fuel feed 41 of the fuel tank 10.

A control chamber 4 is arranged in the bypass line 1 upstream of the flow valve 3 viewed in the direction of the flow of the fuel. In the embodiment shown, the control chamber 4 lies between the pressure line 27 and the flow valve 3. The control chamber 4 is delimited by a control membrane 5 having a dry side which is preferably charged with atmospheric pressure. The membrane plate 6 holding the control membrane 5 has an actuating pin 7 which controls a feed valve 8. The feed valve 8 thereby always opens when the control membrane drops into the control chamber 4 because of increased underpressure.

In FIG. 1, the injection-pump block is identified by reference numeral 12. The fuel-feed pump 20, the injection pump 11, the bypass line 1, the flow valve 3 and the section 52 of the intake channel E are all integrated in the block 12.

Figure 3:
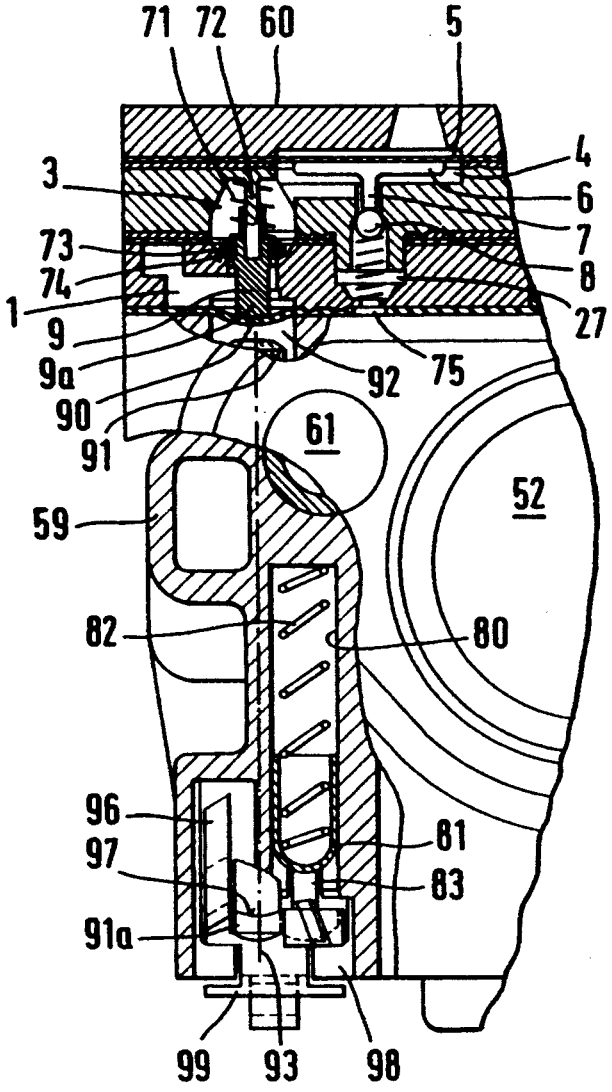
FIG. 3 is a partial section view taken through the injection-pump block of FIG. 3.
Figure 4:
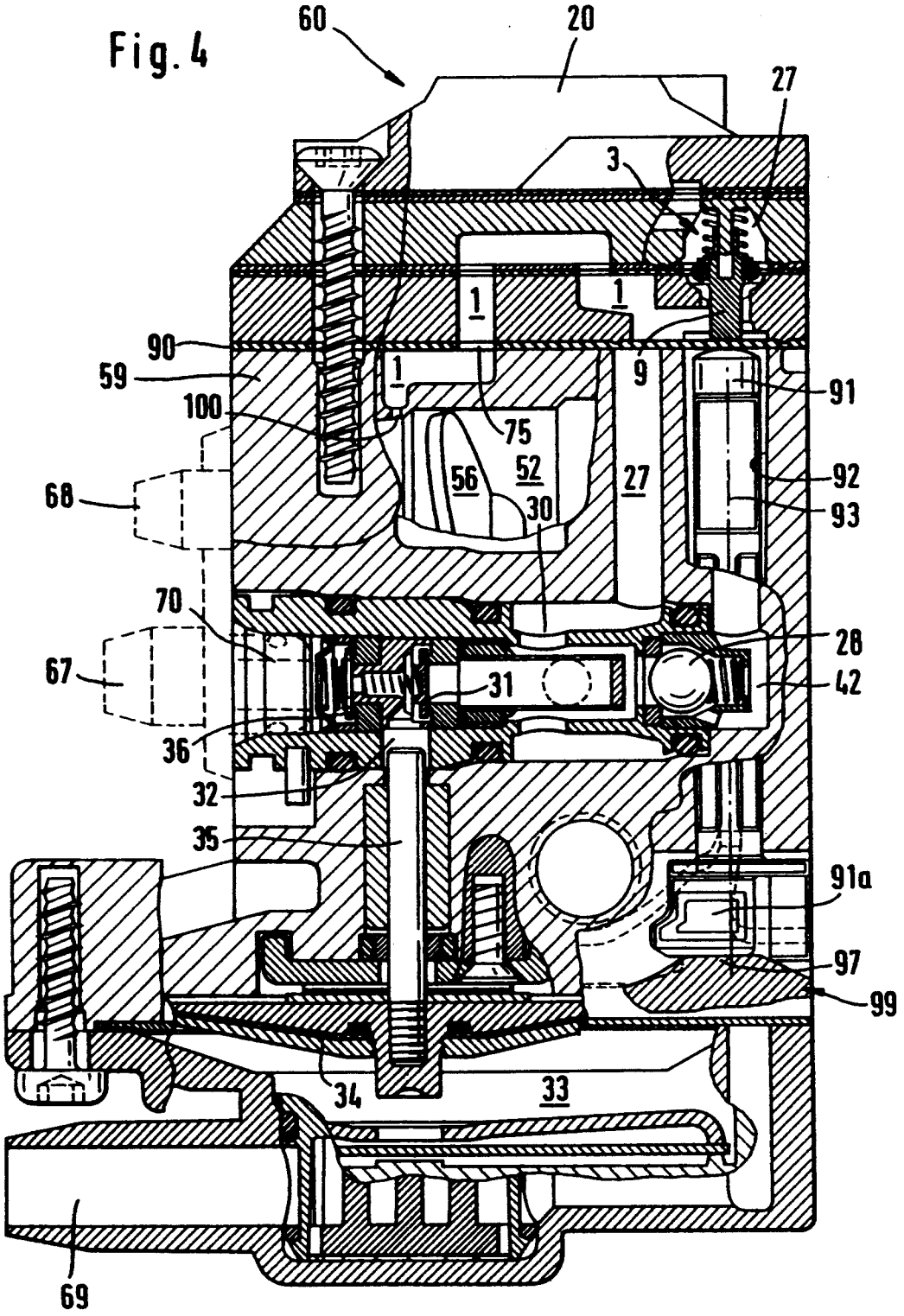
FIG. 4 is a section view taken through the injection-pump block of FIG. 2.

The integration of the bypass line 1, the flow valve 3 and the control chamber 4 can be seen in detail in FIGS. 3 and 4. The section view of FIG. 3 shows that the control chamber 4, the feed valve 8, the flow valve 3 and a portion of the bypass line 1 are integrated in the attachment unit 60 containing the fuel-feed pump 20. The valve member 9 of the flow valve 3 is disposed completely in an expanded chamber of the bypass line 1 and is resiliently biased into its closed position by a spring 71. The valve member 9 is held so as to be axially displaceable on a lug 72 fixed to the housing. The valve member 9 carries a sealing ring 73 which comes into seal-tight engagement on the valve seat 74 in the closed position of the valve member 9.

The end 9*a* of the valve member 9 projects through the valve seat 74 and lies against a sealing membrane 90 which seals off the attachment unit 60 with respect to the base housing 59 of the injection-pump block 12. The attachment unit 60 contains the fuel-feed pump 20. The sealing membrane 90 has openings 75 via which channels provided in the attachment unit 60 are connected to channels provided in the base housing 59.

As shown in FIG. 4, a portion of the bypass line 1 is formed in the attachment unit 60 and the bypass line 1 extends via one opening 75 in the sealing membrane 90 into the channel section provided in the base housing 59. This channel section terminates in a fuel nozzle 100 which opens into the section 52 of the intake channel downstream of the throttle flap 56 viewed in the flow direction of the combustion air.

In the closed position of the flow valve 3 shown in FIG. 3, the helical spring 71 arranged coaxially to the lug 72 holds the valve member 9 in the closed position, with the end 9*a* of the valve member 9 bulging the sealing membrane into a bore 92 of the base housing 59.

As shown in FIG. 4, an actuating pin 91 is guided in this bore 92 and thereby lies on the dry side of the sealing membrane 90. The actuating pin 91 projects through the base housing 59 in the axial direction of the valve member 9 and lies with its end 91*a* on a slider 99 as also shown in FIG. 5. The end 91*a* faces away from the flow valve 3. As shown in FIG. 4, the slider 99 is held so as to be displaceable in a guide 98 (FIG. 3) of the base housing 59 in a direction transverse to the longitudinal center axis 93 of the actuating pin 91. The slider 99 has a ramp 97 which coacts with the end 91*a* of the actuating pin 91 as shown in FIG. 5. The ramp 97 rises and drops in the longitudinal direction of the slider 99.

When the slider 99 is moved in the guide 98 out of its rest position transversely to the longitudinal center axis 93 of the actuating pin 91, the end 91*a* of the actuating pin 91 moves up on the ramp 97 and is lifted whereby the actuating pin 91 moves on the dry side of the sealing membrane 90 toward the valve pin 9 and lifts the same thereby opening the flow valve 3 (FIG. 4). In principle, the opening of the flow valve 3 is also controllable in the same manner via the slider position and the slope of the ramp 97. An on/off control is preferred and, for this purpose, the slider 99 can be latched in the closed position of the flow valve 3 (FIG. 3) and in the open position of the flow valve 3 (FIG. 4). For this purpose, a latch pin 81 is mounted in the base housing 59 with the latch pin 81 being displaceably guided in a bore 80. The latch pin 81 is resiliently biased toward the slider 99 by a spring which is preferably configured as a helical spring 82. The slider 99 has a latch edge 83 having latch cutouts 83*a* which determine the open position (FIG. 4) and the closed position (FIG. 3) of the flow valve 3.

The slider 99 is hinge connected to a pull rod 199 and is preferably connected via the pull rod to a start lever, start actuating device or the like in order to displace the slider 99 into the position shown in FIG. 4 for a start of the engine. The flow valve 3 is opened in the position of the slider shown in FIG. 4.

Referring to FIG. 5, the slider 99 is displaced in the direction shown by the arrow 200 and in a direction opposite thereto. If the slider is moved to the left, then the ramp 97 lifts the actuating pin 91 thereby opening the bypass valve 3. At the same time, the throttle flap 56 is pivoted on pivot pin 55 in the direction of arrow 160 via the angle lever 155 as shown in FIG. 6 because a projection 156 of the lever 155 is lifted by the ramp 197 in side wall 96. Accordingly, by displacing the slider 99 in the direction of arrow 200, the bypass valve 3 is lifted by the actuating pin 91 while at the same time, the pivot pin 55 with the throttle flap 56 is pivoted into a start position via the angle lever 155 and the projection 156. The slot 157 provides a connection to the throttle linkage which, in turn, is connected to the throttle lever (not shown).

Two-stroke engines are started as a rule with a manual-start device and the fuel-feed pump 20 pumps fuel after a few revolutions. For these reasons, fuel is supplied to the intake channel in the start position of the slider 99 via the bypass line 1 before the injection pump 11 starts to perform its function. In this way, a rapid start of the engine is provided by the bypass line 1 conducting the fuel. After the engine has started, the injection pump 11 starts already to perform its function after a short time so that the flow valve 3 can again be closed by displacing the slider 99 in its guide 98.

The throttle flap 56 is preferably adjustable in position via the side wall 96 of the slider 99 by acting on an end of the throttle flap pivot pin 55 via angle lever 155 as described above so that, in the start position of the slider 99 shown in FIG. 4, not only is the flow valve 3 opened, but the throttle flap 56 is displaced simultaneously into a pregiven position which is optimal for the start position.

It can be advantageous to preset several positions of the throttle flap 56 in order to take into consideration different start and operating conditions. In a first position, a very rich mixture is provided (choke operation) and, in a second position, an increased air throughput with a normal mixture results (start gas position, hot start position). In this way, for the open flow valve, the throttle flap 56 can be adjusted one time in the idle position and one time in the start gas position. If the valve 3 is closed, the throttle flap 56 can be freely moved for the injection pump operation.

It is understood that the foregoing description is that of the preferred embodiments of the invention and that various changes and modifications may be made thereto without departing from the spirit and scope of the invention as defined in the appended claims.

What is claimed is:

1. A fuel, injection arrangement for an internal combustion engine such as a two-stroke engine of a portable handheld work apparatus such as a motor-driven chain saw and the like, the engine having an intake channel for conducting combustion air into the engine, the fuel-injection arrangement comprising:

a fuel tank for supplying fuel for the engine;

a fuel-feed pump having a suction line connected to said fuel tank and a pressure line;

a fuel-injection pump having a suction end connected to said pressure line and a pressure end for supplying fuel;

an injection line connected to said pressure end for conducting the fuel to said engine;

a bypass line bypassing said fuel-injection pump for conducting fuel into said intake channel of said engine;

a switchable flow valve connected into said bypass line;

an injection-pump block; and, said fuel-feed pump, said fuel-injection pump, said bypass line, said flow valve, and a section of said intake channel all being arranged in said injection-pump block.

2. The fuel-injection arrangement of claim 1, said engine also including a throttle flap pivotally mounted in said intake channel; and, said bypass line opening into said intake channel downstream of said throttle flap viewed in the direction of flow of the combustion air.

3. The fuel-injection arrangement of claim 2, said bypass line having a first end opening into said intake channel and a second end connected into said pressure line of said fuel-feed pump.

4. The fuel-injection arrangement of claim 2, said injection-pump block including a control chamber integrated therein and said control chamber by connected into said bypass line upstream of said flow valve viewed in the direction of flow of the fuel through said bypass line.

5. The fuel-injection arrangement of claim 4, further comprising a cavity formed in said block and a control membrane partitioning said cavity into said control chamber and a dry space communicating with the ambient atmosphere so as to cause said control membrane to be charged with atmospheric pressure.

6. The fuel-injection arrangement of claim 5, further comprising a feed valve for passing fuel into said control chamber; a control plate for holding said control membrane; and, said control plate having an actuating pin for actuating said feed valve.

7. The fuel-injection arrangement of claim 1, said injection-pump block having a sealing membrane partitioning said block into a wet region for accommodating said flow valve and a dry region adjacent said flow valve; said flow valve having a movable valve member for opening and closing said flow valve; said valve member being in contact engagement with said sealing membrane; and, valve actuating means arranged in said dry region for actuating said valve member; and, said valve actuating means including an actuating rod for acting on said valve member via said sealing membrane for opening and closing said flow valve.

8. The fuel-injection arrangement of claim 7, said actuating rod having a longitudinal axis and said actuating rod being mounted in said block so as to be displaceable along said axis.

9. The fuel-injection arrangement of claim 8, said valve actuating means further comprising a slider slideably mounted in said block so as to be movable between first and second positions transversely to said axis; said actuating rod having a first end for acting on said valve member via said membrane and a second end opposite said first end; and, said slider including means contact engaging said second end for raising and lowering said actuating rod as said slider is moved between said first and second positions.

10. The fuel-injection arrangement of claim 9, said slider including means for moving said throttle flap into a predetermined position when said slider is moved so as to open said flow valve.

11. The fuel-injection arrangement of claim 7, said injection-pump block being partitioned into a first portion containing said wet region and a second portion defining a base housing and containing said dry region; said fuel-feed pump having a housing arranged in said first portion and said sealing membrane being adapted to seal off said housing of said fuel-feed pump from said base housing.

12. A fuel-injection arrangement for an internal combustion engine such as a two-stroke engine of a portable handheld work apparatus such as a motor-driven chain saw and the like, the engine having an intake channel for conducting combustion air into the engine, the fuel-injection arrangement comprising:

a fuel tank for supplying fuel for the engine;

a fuel-feed pump having a suction line connected to said fuel tank and a pressure line;

a fuel-injection pump having a suction end connected to said pressure line and a pressure end for supplying fuel;

an injection line connected to said pressure end for conducting the fuel to said engine;

a bypass line bypassing said fuel-injection pump for conducting fuel into said intake channel of said engine;

a switchable flow valve connected into said bypass line; and, said flow valve including a housing; and, a sealing membrane partitioning said housing into a wet region for accommodating said flow valve and a dry region adjacent said flow valve; said flow valve having a movable valve member for opening and closing said flow valve; said valve member being in contact engagement with said sealing membrane; and, valve actuating means arranged in said dry region for actuating said valve member; and, said valve actuating means including an actuating rod for acting on said valve member via said sealing membrane for opening and closing said flow valve.

* * * * *

UNITED STATES PATENT AND TRADEMARK OFFICE

CERTIFICATE OF CORRECTION

PATENT NO. : 5,365,893

DATED : November 22, 1994

INVENTOR(S) : Michael Wissmann, Hans Nickel, Roland Schierling, Roland Adam and Werner Geyer It is certified that error appears in the above-identified patent and that said Letters Patent is hereby corrected as shown below:

In column 6, line 47: delete "fuel, injection" and substitute -- fuel-injection -- therefor.

In column 7, line 14: delete "by" and substitute -- being -- therefor.

Signed and Sealed this

Seventeenth Day of January, 1995

*Attest:*

*Attesting Officer*

BRUCE LEHMAN

*Commissioner of Patents and Trademarks*